US007912386B2

(12) United States Patent
Wayman

(10) Patent No.: US 7,912,386 B2
(45) Date of Patent: Mar. 22, 2011

(54) SYSTEMS AND METHODS FOR DETERMINING A CHARGE-TO-MASS RATIO, AND A CONCENTRATION, OF ONE COMPONENT OF A MIXTURE

(75) Inventor: William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 1126 days.

(21) Appl. No.: 11/613,731

(22) Filed: Dec. 20, 2006

(65) Prior Publication Data

US 2008/0152367 A1 Jun. 26, 2008

(51) Int. Cl.
*G03G 15/08* (2006.01)

(52) U.S. Cl. ..... 399/30

(58) Field of Classification Search ..... 399/30
See application file for complete search history.

(56) References Cited

U.S. PATENT DOCUMENTS 5,006,897 A * 4/1991 Rimai et al. ..... 399/61 X
5,422,664 A 6/1995 Stephany
6,941,084 B2 9/2005 Hamby et al.

* cited by examiner

*Primary Examiner* — David M Gray
*Assistant Examiner* — Erika Villaluna
(74) *Attorney, Agent, or Firm* — Oliff & Berridge, PLC

(57) ABSTRACT

Systems and methods are provided for using a sensor to determine a charge-to-mass ratio, and a concentration, of a mixture including a first component and a second component. A base resonance frequency of the sensor in an unloaded state is measured. A surface of a vibrating element of the sensor is loaded with the mixture. A first resonance frequency, of the loaded sensor is measured and a mass of the mixture is calculated. A first component is attracted to, and a second component is removed from, the vibrating element of the sensor. A second resonance frequency, and a first charge, of the sensor are measured. The first component is removed and a second charge is measured. A mass and charge of the first component are calculated. Charge to mass ratio, and the concentration, of the first component are then derived from the calculated values.

20 Claims, 8 Drawing Sheets

SYSTEMS AND METHODS FOR DETERMINING A CHARGE-TO-MASS RATIO, AND A CONCENTRATION, OF ONE COMPONENT OF A MIXTURE

This disclosure is directed to systems and methods for determining a charge-to-mass ratio, and a concentration, of one component of a mixture.

BACKGROUND

In a related art electrophotographic printing process, a photoconductive member is charged to a substantially uniform potential so as to sensitize the surface thereof. The charged portion of the photoconductive member is exposed to a light image of an original document being reproduced. Exposure of the charged photoconductive member selectively dissipates the charges thereon in irradiated areas. This records an electrostatic latent image on the photoconductive member corresponding to informational areas contained within the original document.

After the electrostatic latent images are recorded on the photoconductive member, the latent images are developed by bringing developer material into contact therewith.

The developer material may include toner particles adhering triboelectrically to carrier granules. This two-component developer may be mixed and stored in a developer housing. Typically, individual toner particles are maintained within the developer housing for a relatively short period of time, preferably not exceeding several days.

The toner particles are attracted from the carrier granules to the latent images, forming a toner powder image on the photoconductive member. The toner powder image is then transferred from the photoconductive member to a recording medium such as, for example, a copy sheet. The toner particles are heated to permanently affix the powder image to the copy sheet. After each transfer process, the toner remaining on the photoconductive member is cleaned by a cleaning device.

In order to operate effectively, a proper concentration of the toner particles relative to the carrier granules is desirable. Excessive toner concentration within the developer housing can lead to prints that are too dark. Insufficient toner concentration can lead to prints that are too light.

Systems are known that measure toner concentration based on a magnetic permeability of the developer. Generally, carrier granules are magnetically permeable, whereas toner particles are relatively non-magnetic. Thus, toner concentration affects the permeability of the mixture. Lower concentrations of toner particles lead to greater permeability of the mixture and vice-versa.

Various factors, which will be discussed further below, affect the accuracy of sensors that measure toner concentration, such as permeability sensors, thus requiring more refined testing in order to accurately calibrate image forming devices that rely on maintaining consistent levels of toner concentration. Such calibrations may include, for example, the relative rate of toner size or charge distribution within the device.

Other systems are used to measure both toner concentration and charge-to-mass ratio of developer material samples extracted from image forming devices. Toner concentration and charge-to-mass ratio of two-component developers can be measured with an air blow-off or blow-through technique using "tribocages." In such a technique, a sample of developer material is placed in a metal cylinder with screen ends, e.g. a tribocage. The screens have apertures that are small enough to retain the carrier, but large enough to allow toner from the developer material to pass through. Compressed air is blown through a first screen of the tribocage, stripping the toner particles from the carrier granules and forcing the toner particles through an opposite screen and out of the tribocage.

The change in charge and weight of the tribocage between the beginning of blow-through and end of blow-through is measured, thereby deriving the charge (Q) and mass (M) of the toner particles that have been removed from the tribocage. The mass of the two-component developer sample may be calculated by subtracting the weight of the tribocage (empty) from the measured weight of the sample (pre-blow-through) and the tribocage. The calculated mass of the toner particles may then be divided by the mass of the two-component developer sample to derive TC (toner concentration in %). The charge of toner particles may be divided by the mass of the toner particles to derive charge-to-mass ratio of the toner (Q/M).

SUMMARY

As mentioned previously, the methods for detecting toner concentration within the developer housing are not always accurate. Concentration measurements can be unfavorably influenced by environmental factors, such as humidity, as well as operational factors, such as the rate of toner usage and age of the developer material. For example, developer material that is maintained within the housing for excessive periods of time may undergo physical deformation such as smoothing or abrading of edges of the components. Such physical deformation may alter the permeability of the components, thus rendering the permeability measurements inaccurate with respect to the toner concentration. That is, the toner concentration may be more or less than the measured amount. These types of inaccuracies make it desirable to perform more accurate measurements of toner concentration.

With regard to known methods for calculating concentration and charge-to-mass ratio of two-component developer, the tribocage apparatus required for such measurements is expensive, large and/or not portable. Such a tribocage apparatus may require a sample of approximately 0.5 g, a source of dry compressed air, a sensitive balance and an electrometer, as well as extensive operator training to achieve repeatable and accurate results. As such, in order to test developer from widely dispersed image forming devices, samples must be sent to centralized lab/test facilities with the necessary equipment and personnel. Such methodology is time consuming and requires the removal, packaging, transportation and unpackaging of the samples in order to achieve effective results.

It would be desirable to provide an apparatus achieving enhanced characteristics compared to the above related art apparatus and methods. For example, it may be advantageous to provide an apparatus that is more capable, portable, and/or less expensive than the related art apparatus. It may be further advantageous to provide an apparatus that does not require a trained operator. It would also be desirable to enable field service personnel to measure Q/M and TC in operational locations. It would also be advantageous to provide a system and method that would reduce the time and sample size required for lab-quality measurements.

In various exemplary embodiments, systems and methods according to this disclosure provide enhanced capability for determining a charge-to-mass ratio, and a concentration, of one component of a mixture.

Exemplary embodiments of the disclosed systems and methods may employ at least one sensor, including a vibrating element for receiving a sample to be measured and a plurality of electrical elements. Control circuitry may be operatively connected to the sensor and configured to detect a resonance frequency, and a charge, of the sensor. A magnetic device may be provided that creates a magnetic field in proximity to the sensor. A biasing device, that provides a bias to the plurality of electrical elements may also be provided. A first removal device may remove components of the sample from the vibrating element. A calculator may calculate a sample mass based on a resonance frequency of the sensor. A concentration may also be calculated based on a first sample mass and a second sample mass, the second sample mass determined after removal of components of the sample from the vibrating element of the sensor. A sample charge-to-mass ratio may also be calculated based on the calculated mass and the detected charge.

In accordance with exemplary embodiments of the disclosure, a second removal device for otherwise removing components from the vibrating element may be provided.

In accordance with exemplary embodiments of the disclosure, the sample may be a two-component developer used in an electrostatic image forming device.

In accordance with exemplary embodiments of the disclosure, the sensor may be a piezoelectric element.

In accordance with exemplary embodiments of the disclosure, the biasing device and the magnetic device may be configured to separate a mixture on the surface of the sensor, the mixture including at least two components, a first component having substantially different dielectric properties or mass compared to a second component.

In accordance with exemplary embodiments of the disclosure, the second removal device may be configured to alter a magnetic field applied to the sensor.

In accordance with exemplary embodiments of the disclosure, the sensor may be configured to smooth and position the sample by increasing a drive voltage applied to the sensor.

In accordance with the exemplary embodiments of the disclosure, the biasing device and the magnetic device may be configured to attract a first component of the sample to the vibrating element of the sensor by increasing a drive voltage applied to the sensor and reducing a magnetic field in proximity to the sensor.

In accordance with exemplary embodiments of the disclosure, a base resonance frequency of a sensor in an unloaded state may be measured. A mixture of at least two components may be loaded on a vibrating element of the sensor. A first resonance frequency of the loaded sensor may be measured. All of the second component may be substantially removed from the vibrating element of the loaded sensor. A second resonance frequency, and a charge, of the sensor substantially loaded with only the first component may be measured. A mass of the second component may be calculated based on a difference between the resonance frequency of the sensor loaded with the first and second components and without the second component. The first component may be removed from the vibrating element of the sensor. A mass of the first component may be calculated based on a difference between the resonance frequency of the sensor loaded with the first component and without the second component, and the unloaded sensor. A charge of the first component may be calculated based on a difference between the charge of the sensor loaded with the first component and the unloaded sensor. A charge to mass ratio, and the concentration, of the first component may be calculated based on the calculated mass of the first component, the calculated mass of the second component, and the calculated charge of the first component. At least one of the detected or calculated mass, charge, concentration and charge to mass ratio may be stored, output or utilized.

In accordance with exemplary embodiments of the disclosure, the first component may be removed from the vibrating element of the sensor. A mass of the first component may be calculated based on a second detected change in the resonance frequency. A charge of the first component may be calculated based on a second detected change in the charge of the sensor.

In accordance with exemplary embodiments of the disclosure, the first component may have substantially different dielectric properties or mass than the second component.

In accordance with exemplary embodiments of the disclosure, a mass of the mixture may be calculated based on a difference between the base resonance frequency and the first resonance frequency.

In accordance with exemplary embodiments of the disclosure, the first component may be attracted to the vibrating element of the loaded sensor.

In accordance with exemplary embodiments of the disclosure, a mass of the first component may be calculated based on a difference between the base resonance frequency and the second resonance frequency.

In accordance with exemplary embodiments of the disclosure, a charge of the first component may be calculated based on a difference between a first charge and the second charge.

In accordance with exemplary embodiments of the disclosure, attracting the first component may include separating the first component from the second component, the second component carrying the first component.

In accordance with exemplary embodiments of the disclosure, removing the second component from the surface of the sensor may be achieved by altering a magnetic field applied to the sensor.

In accordance with exemplary embodiments of the disclosure, placing the sample on the sensor may include smoothing and positioning the sample by increasing the vibration amplitude of the sensor.

In accordance with exemplary embodiments of the disclosure, attracting the first component to the vibrating element of the sensor may include increasing the vibration amplitude of the sensor and reducing a magnetic field in proximity to the sensor.

These and other objects, advantages and features of the systems and methods according to this disclosure are described and/or apparent from the following description of exemplary embodiments.

BRIEF DESCRIPTION OF THE DRAWINGS

Various exemplary embodiments of the disclosed systems and methods will be described, in detail, with reference to the following figures, wherein.

DETAILED DESCRIPTION OF EMBODIMENTS

Figure 1:
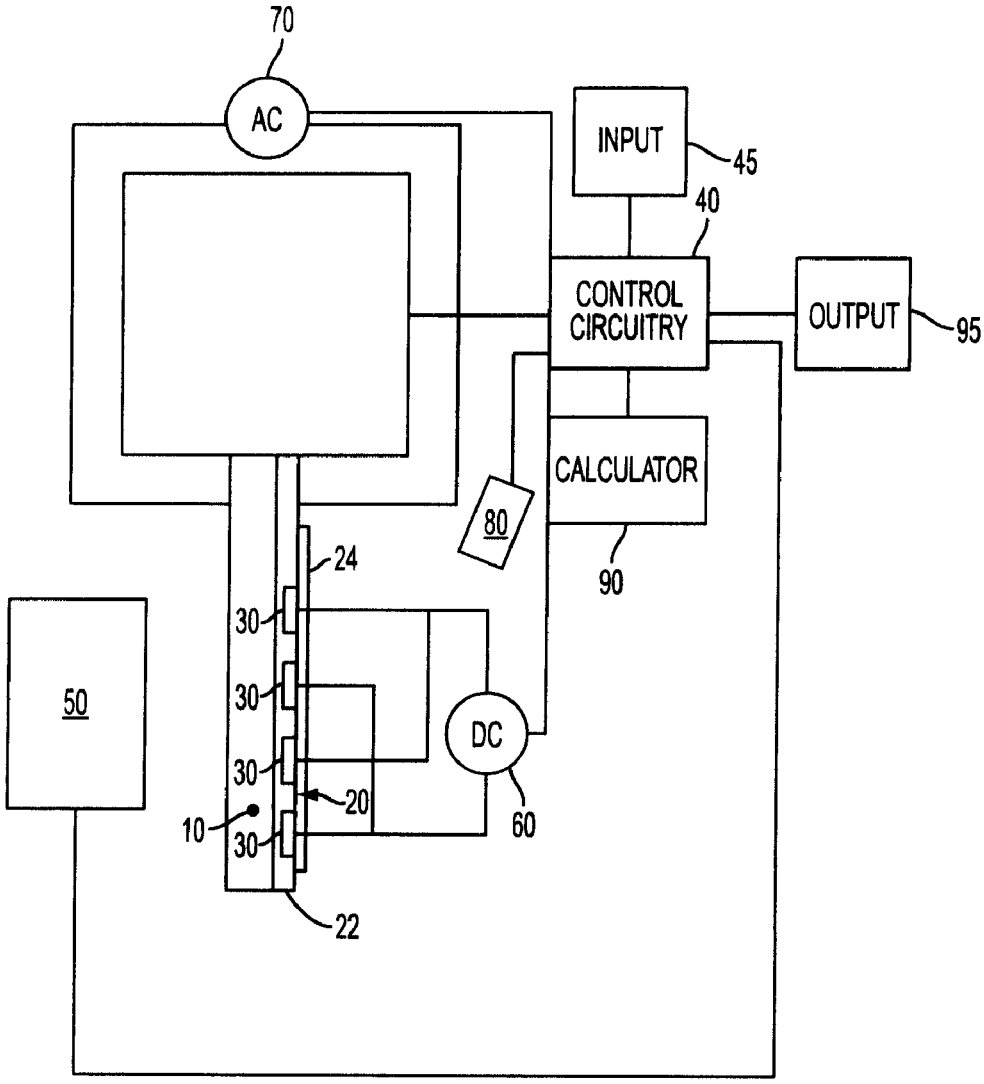
FIG. 1 is a schematic side view of an exemplary system for determining a charge-to-mass ratio, and a concentration, of one component of a mixture.

The following description of various exemplary systems and methods for determining a charge-to-mass ratio, and a concentration, of one component of a mixture may refer to and/or illustrate a specific type of device or mixture for the sake of clarity, familiarity, and ease of depiction in description. However, it should be appreciated that the principles disclosed herein, as outlined and/or discussed below can be equally applied to any known, or later-developed, useful mixture or system in which it is desirable to determine a charge-to-mass ratio, and/or a concentration, of one component of a mixture.

With reference to the Figures, the same reference numerals are used to identify like elements in various embodiments.

Figure 9:
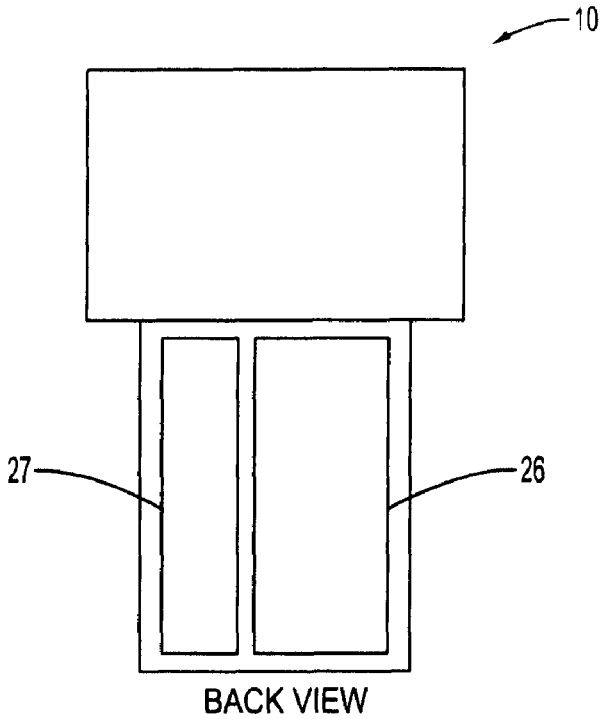
FIG. 9 is a schematic rear view of an exemplary sensor for use in determining a charge-to-mass ratio, and a concentration, of one component of a mixture.

FIG. 1 illustrates an exemplary measuring device 1 for determining a charge-to-mass ratio, and a concentration, of one component of a mixture. A sensor 10, for example, a piezoelectric element, may include a vibrating element 20 for receiving a sample of the mixture to be measured. The vibrating element 20 of the sensor 10 may have a dielectric layer 22 with attached plurality of electrical elements 30. The dielectric layer 22 and electrical elements 30 may be overcoated with a highly resistive dielectric layer 24. Exemplary embodiments of these features are also depicted in FIGS. 9 and 10.

A control circuitry 40 may be operatively connected to the sensor 10. The control circuitry 40 may be configured to detect a resonance frequency and a charge of the sensor 10. For example, the sensor 10 may expand or contract when an external driving voltage is applied. A "bi-morph" structure may be used in which two elements (not shown) are mounted back-to-back to form a cantilever beam that bends when a driving voltage is applied. Such a bi-morph piezoelectric element can also be used as a motion sensor, as it creates a voltage when an external mechanical force causes it to bend.

Figure 10:
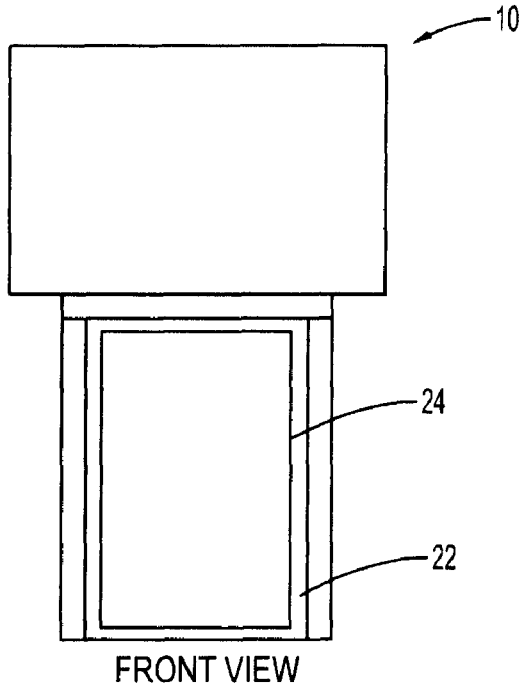
FIG. 10 is a schematic front view of an exemplary sensor for use in determining a charge-to-mass ratio, and a concentration, of one component of a mixture.
Figure 11:
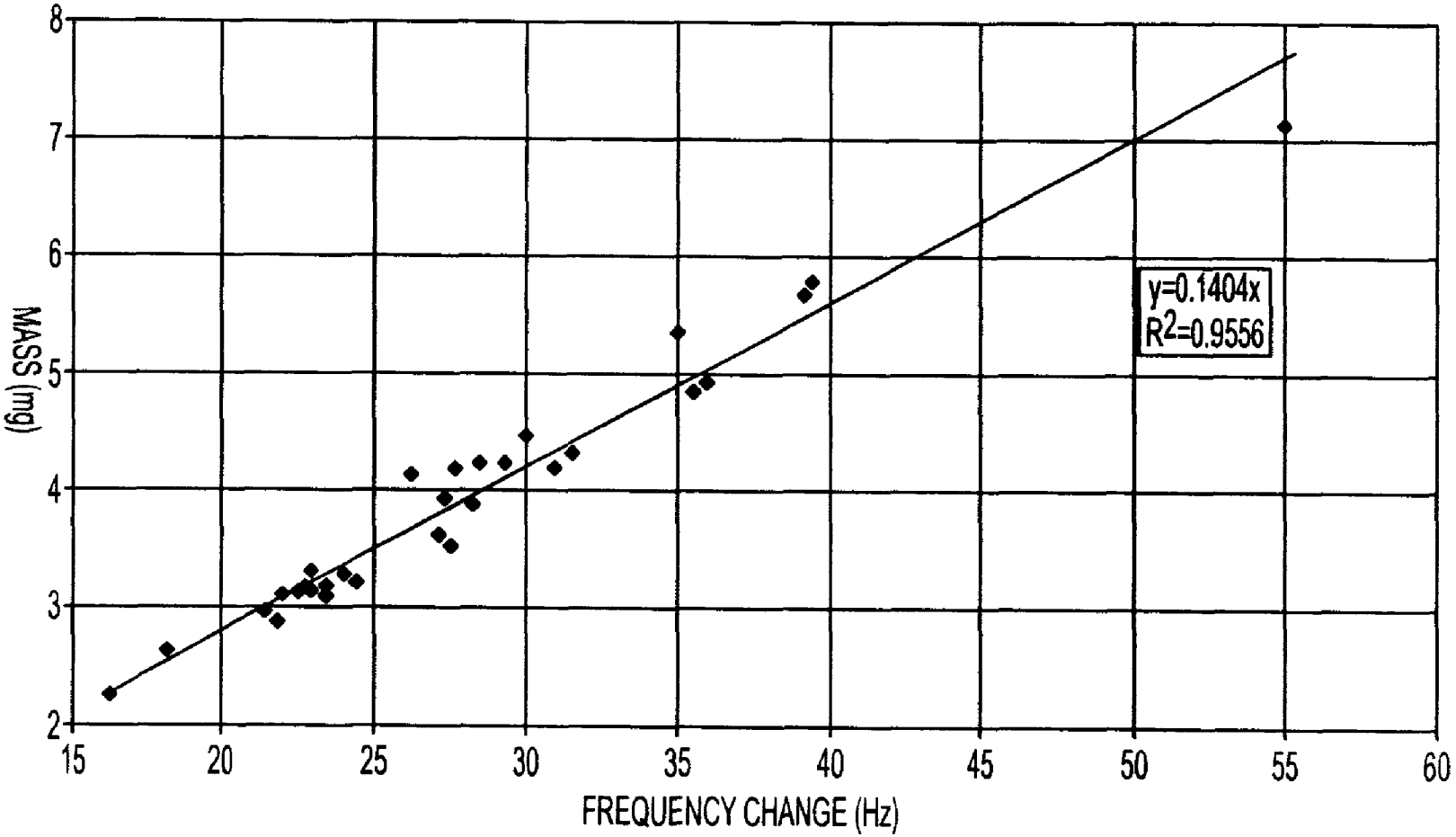
FIG. 11 is a chart reflecting test results achieved by a disclosed embodiment.

As shown in FIG. 10, a piezoelectric bi-morph containing both a drive electrode 26 and a sensor electrode 27 may be used wherein the natural resonant frequency can be sensed when a 90° phase difference is obtained between the drive and sense voltage. The resonant frequency is dependent on stiffness and mass of the piezoelectric element. Adding mass to the piezoelectric element will lower the resonant frequency. The amount of frequency shift can be used to calculate the added mass.

A magnetic device 50, operatively controlled by the control circuitry 40, may create a magnetic field in proximity to the sensor. Such a magnetic device placed in, on or in proximity to the sensor may attract or position a sample, or components of a sample, to or away from the vibrating element 20 of the sensor 10.

Figure 6:
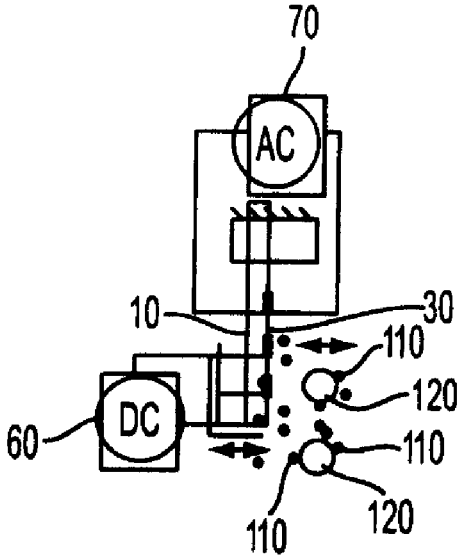
Figure 7:
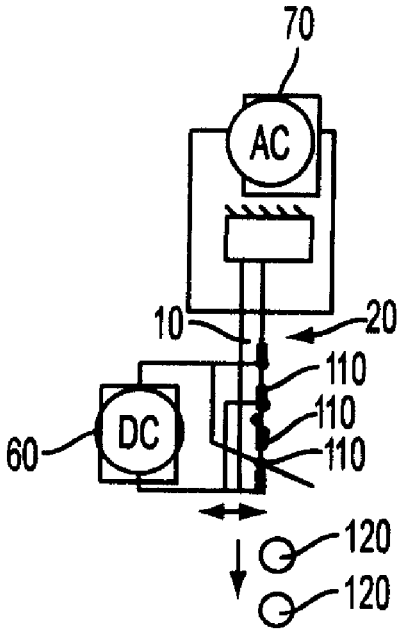

A biasing device 60 may be operatively connected to the control circuitry 40 and the plurality of electrical elements 30. The biasing device 60 may apply an electrical bias to the plurality of electrical elements 30, for example a set of inter-digitated electrodes. Such bias may be used to separate and/or adhere components of a mixture such as, for example, extracting ("developing") toner particles from carrier granules, as depicted in FIGS. 6 and 7. This separation, or development, may occur in the presence of a magnetic field from magnetic device 50. The combination of inertial mechanical forces applied to the sample mixture and the electric field forces from the inter-digitated electrodes may be used to cause adhesion of one component of the mixture and vibration or "bouncing" of the second component of the mixture. The magnetic field may then be reduced, resulting in the vibrating components being removed from the surface of the sensor.

A first removal device may also be provided to assist in the removal of components of the sample from the vibrating element 20. The magnetic device 50, biasing device 60 and/or vibration controller 70, or combinations of these devices, may act as the first removal device. These devices may be controlled in a coordinated fashion such that components of varying electrostatic charge and/or mass are separated from each other and selectively removed, via gravity or assisted methods, from the vibrating element 20 of the sensor 10.

A calculator 90 may be operatively connected to the control circuitry and configured to calculate: a sample mass, based on a resonance frequency of the sensor; a concentration of a component of the sample based on a first sample mass and a second sample mass, the second sample mass determined after removal of select components of the sample from the surface; and a charge-to-mass ratio of the sample, or components of the sample. Methods for calculating various values relative to specific components are discussed below.

Figure 2:
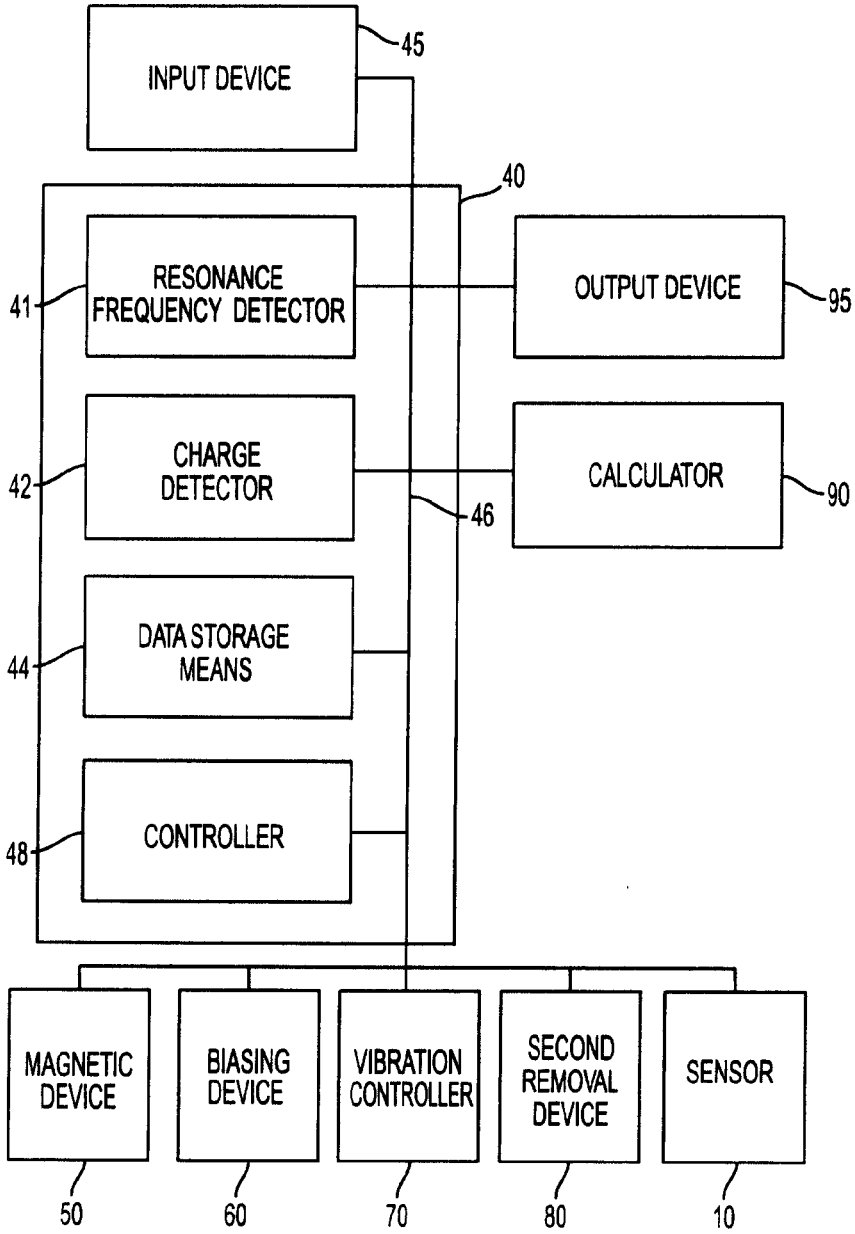
FIG. 2 is a schematic block diagram of an exemplary system for implementing a method to determine a charge-to-mass ratio, and a concentration, of one component of a mixture.

Measured or calculated mass, concentration, charge, and/or charge-to-mass ratio may be output via an output device 95 such as, for example, a printer, display, or other device, or stored in devices such as data storage means 44, shown in FIG. 2.

A second removal device 80 may be provided for otherwise removing components from the vibrating element 20. Such devices may include a compressed air discharge unit (not shown) that may blow air across the vibrating element 20 of the sensor 10. The biasing device 60 may be configured to act in coordination with, or as part of, the second removal device 80 by switching the bias of the plurality of electrical elements 30 to assist in removal of components from the vibrating element 20 of the sensor 10.

It should be appreciated that the biasing device 60, vibration controller 70 and the magnetic device 50 may be configured to separate a mixture including at least two components, such as a first component having substantially different dielectric properties or mass than a second component, on the surface of the sensor.

It should also be appreciated that the second removal device 80 may be configured to operate in conjunction with altering a magnetic field applied to the sensor 10.

It should be appreciated that the sensor may be configured to smooth and position the sample by increasing the vibration amplitude applied to the sensor 10. Such smoothing and positioning should be understood as some leveling and distributing of the sample upon the vibrating element 20 of the sensor 10. Smoothing and positioning may be desirable in order to locate the sample more precisely and/or uniformly on the sensor, which may increase the accuracy of mass measurements. Although the sensor may vibrationally smooth and position the sample, any known or later developed device may be used to smooth and position the sample.

It should be further appreciated that the biasing device 60, vibration controller 70 and the magnetic device 50 may be configured to attract a first component of a sample to the vibrating element 20 of the sensor 10 by increasing the vibration amplitude of the sensor and reducing a magnetic field in proximity to the sensor. However, any known or later developed device that can separate the first component and second component, or that can attract the first component to the surface of the sensor without attracting the second component, may be implemented.

FIG. 2 illustrates a schematic block diagram of an exemplary system for determining a charge-to-mass ratio, and a concentration, of one component of a mixture. Control circuitry 40 may be connected to an input device 45 via a bus 46. The input device 45 may be used to accomplish various objectives including, but not limited to, initiating testing, inputting known variables, and/or controlling testing operations.

A resonance frequency detector 41 may be provided within control circuitry 40 and operatively connected to the sensor 10. The resonance frequency detector 41 is capable of detecting a resonance frequency of the sensor 10, such as, for example, the resonance frequency of a piezoelectric element. A charge detector 42 may also be connected to the sensor 10 for detecting an electrical charge of the sensor 10 along with the electrical charge of an applied sample.

The values detected by the resonance frequency detector 41 and the charge detector 42 may be stored in data storage means 44 for future use. A calculator 90 may access detected values or stored values to calculate a mass of a sample based on changes in the resonance frequency of the sensor 10. The calculator 90 may also determine a charge of a sample based on a change in electrical charge of the sensor 10. Calculated mass values of the sample and a component of the sample may be used to calculate a concentration of a component of a mixture. The calculator 90 may also calculate a charge to mass ratio of a component of a mixture based on a detected electrical charge and a calculated mass of a component of a mixture. Methods for determining specific values with respect to individual components of a mixture are discussed further below.

A controller 48 may be used to control a magnetic device 50, a biasing device 60, a second removal device 80 and/or a vibration controller 70.

The controller 48 may control the movement, strength and/or polarization of the magnetic device 50 to provide and control a magnetic field in proximity to the sensor 10. By varying the magnetic field in any of the described manners, adhesion and removal of components of the mixture to or from the vibrating element of the sensor may be enhanced.

The controller 48 may control an amplitude and/or polarity of charge bias applied to the sensor by a biasing device 60. Such bias may be a direct current voltage applied to the electrodes 30.

The controller 48 may also be configured to control the magnetic device 50, the biasing device 60 and the vibration controller 70 to act as a removal device.

The controller 48 may also control the second removal device 80 such as, for example, an air discharge unit that may blow air across the surface of the sensor 10.

It should be appreciated that, while shown in FIGS. 1 and 2 as a composite unit, the control circuitry 40, and components depicted within or external to the control circuitry 40, may be either a unit and/or a capability internal to the measuring device 1. The control circuitry 40 may also be internal to any component of the measuring device 1, or may be separately presented as a stand-alone system, unit, or device such as, for example, a separate server connected to the measuring device 1. Further, it should be appreciated that each of the individual elements depicted as part of the exemplary measuring device 1 may be implemented as part of a single composite unit or as individual separate devices. For example, the data storage means 44, calculator 90, and controller 48 may be integral to a single composite unit representing the overall system. Further, as noted above, it should be appreciated that, while depicted as separate units, the various components such as, for example, data storage means 44, calculator 90, and controller 48 may be separately attachable to the system as composite multi-function input/output components.

It should be appreciated that given the required inputs, software algorithms, hardware circuits, and/or any combination of software and hardware control elements, may be used to implement the individual devices and/or units in the exemplary measuring device 1.

It should be appreciated further that any of the data storage devices depicted in FIG. 2, or otherwise as described above, can be implemented using any appropriate combination of alterable, volatile or non-volatile memory, or non-alterable, or fixed, memory. The alterable memory, whether volatile or non-volatile can be implemented using any one or more of static or dynamic RAM, a floppy disk and associated disk drive, a writeable or re-writeable optical disk and associated disk drive, a hard drive/memory, and/or any other like memory and/or device. Similarly, the non-alterable of fixed memory can be implemented using any one or more of ROM, PROM, EPROM, EEPROM and optical ROM disk, such as a CD-ROM or DVD-ROM disk and compatible disk drive or any other like memory storage medium and/or device.

Figure 3:
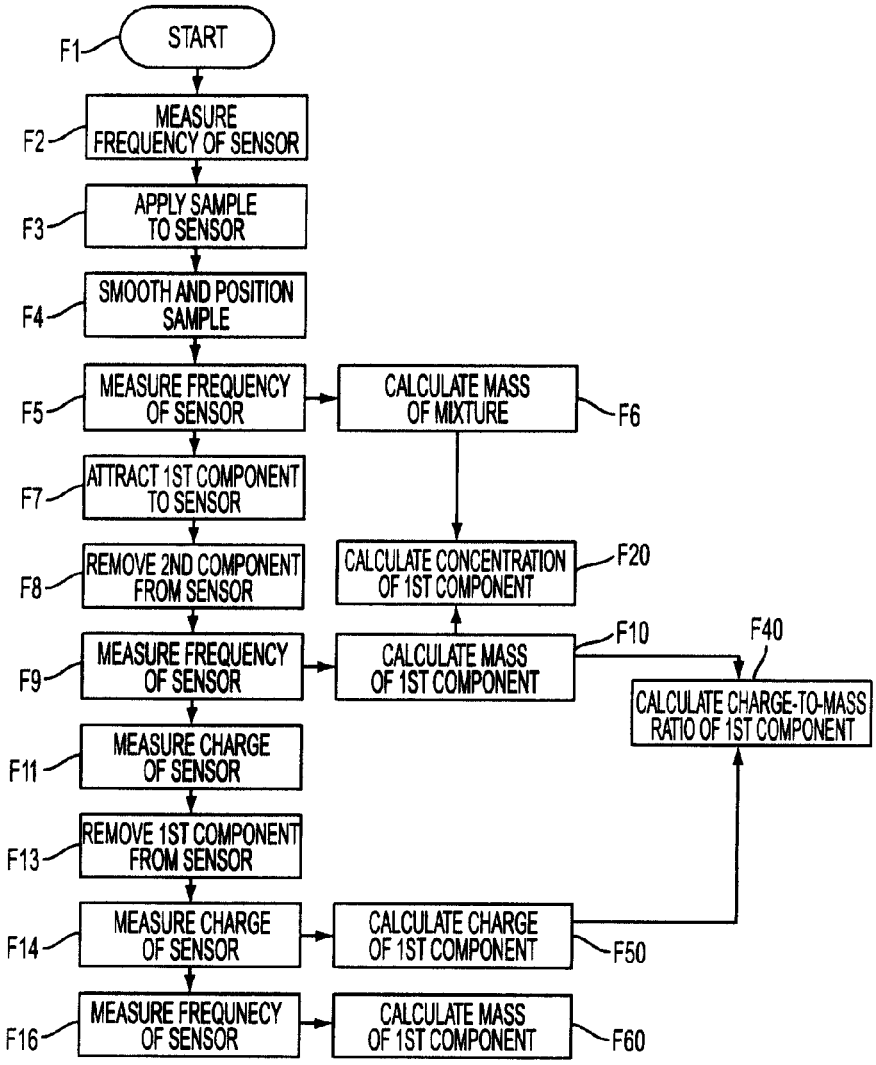
FIG. 3 is a flowchart outlining an exemplary method for determining a charge-to-mass ratio, and a concentration, of one component of a mixture.

FIG. 3 is a flowchart outlining exemplary methods for determining a charge-to-mass ratio, and a concentration, of one component of a mixture.

As depicted in FIG. 3, exemplary methods may commence as shown at F1. A resonance frequency of an unloaded sensor may be measured, as shown at F2.

A sample of a mixture including at least two components, a first component having substantially different dielectric properties or mass than a second component, may be placed on a vibrating element of the sensor, as shown at F3. Placement could be obtained, for example, by use of a small calibrated spoon, or by other known or later developed methods. The mixture may adhere to a surface of the vibrating element due to the properties of the two components. For example, developer may stick to the surface of the vibrating element due to an applied magnetic field on the carrier granules and adhesion forces of the toner.

Exemplary embodiments may include smoothing and positioning the sample when applying the sample to the vibrating element, as shown at F4, by increasing the vibration amplitude of the sensor.

A change in the resonance frequency of the sensor may be detected, as shown at F5. The resonance frequency of the sensor is changed by the mass of the sample added to the sensor, such as, a piezoelectric element. The detected change in resonance frequency may be used, as shown at F6, to calculate a mass of the mixture.

A first component of the mixture, which may have substantially different dielectric properties or mass than a second component, may be electrically attracted to the surface of the vibrating element, as shown at F7. This can be achieved, for example, by biasing alternating electrodes to attract or adhere the first component to the surface of the vibrating element, and increasing the vibration amplitude and/or retracting or reducing the magnetic field from the magnetic device, to vibrate a second component, thus stripping the first component from the second component and causing the second component to fall off the sensor.

The second component may be removed from the surface of the vibrating element, as shown at F8. This may be achieved, for example, by gravitational and/or other forces once the first component is adhered to the sensor.

As shown at F9, once the second component has been removed, the resonance frequency may be measured again to detect a second detected change in the resonance frequency. The second detected change in the resonance frequency represents the resonance frequency of the sensor with the first component adhered to the surface of the vibrating element.

As shown at F10, the mass of the first component may be calculated based on the second detected change in the resonance frequency.

As shown at F20, the mass of the sample, calculated at F6, may be compared to the mass of the first component, calculated at F10, to determine the concentration of the first component in the mixture.

As shown at F11, the charge of the sensor substantially loaded with only the first component may be measured. This value may be used as a reference for later calculation of change in charge at F14.

Embodiments may include the first component being removed from the surface of the sensor, as shown at F13. Such removal may be accomplished by, for example, switching the electrical bias of the plurality of electrodes on the sensor, and blowing compressed air across the sensor.

Exemplary embodiments may include detecting a second charge of the sensor after removing the first component from the sensor, as shown at F14. As shown at F50, a charge of the first component may be calculated based on the change in detected charge (F14-F11) of the sensor. A charge to mass ratio of the first component may be calculated based on the mass of the first component calculated at F10 and the charge of the first component calculated at F50.

As shown at F16, a third detected change in the resonance frequency may be detected. As shown at F60, the third detected change in the resonance frequency may be used to calculate a mass of the first component.

Any of the values calculated during steps F6, F10, F20, F40, F50 and F60 may be independently utilized, saved and/or output. For example, such calculated values may be saved and/or output for the purpose of calibrating the device that uses the mixture such as, for example, an image forming device using a two component developer mixture. It should also be appreciated that such a method may be performed by subsystems of an image forming or other device and the calculated values utilized by the image forming or other device for automated and/or assisted diagnostics, calibration, or other device functions. For example, when used in an image forming device, such calculations may be used to provide alerts when the calculated values are outside of set parameters. The calculated values may also be utilized by image forming devices to calibrate the addition of toner particles to a developer housing. Each of the above described uses of calculated values may be accomplished via a combination of components depicted in FIG. 2, including but not limited to the output device 95, data storage means 44, input device 45 and bus 46.

A pictorial sequence of an exemplary system and method is illustrated in FIGS. 4-8.

Figure 4:
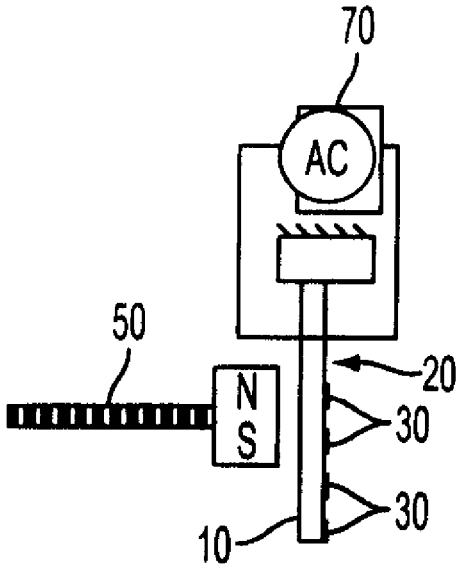
FIGS. 4-8 are schematic side views of a system for determining a charge-to-mass ratio, and a concentration, of one component of a mixture.

FIG. 4 illustrates a sensor 10 having a plurality of electrical elements 30 disposed on, or imbedded in, a dielectric layer 22 of the sensor 10. The dielectric layer 22 and electrical elements 30 may be overcoated with a highly resistive dielectric layer 24 to avoid electrical shorting by the applied sample mixture, as shown also in FIG. 10 where the electrodes 30 are covered by the layer 24. An alternating current may be applied to the sensor 10 by a vibration controller 70. The sensor 10 may be a bi-morph piezoelectric element, a cantilever type sensor, or the like.

The resonance frequency of the sensor 10 may be accurately determined by sweeping the drive frequency while sensing the phase difference between the drive and sense signals. The highest amplitude of oscillation occurs when the sense signal lags the drive signal by 90 degrees. Amplitude could be used to determine the resonant frequency, however using phase shift as an indicator of resonance is a much more accurate method. The determination of phase can be determined by Lissajous figures from oscilloscope or by using modern digital sampling and signal processing techniques.

Figure 5:
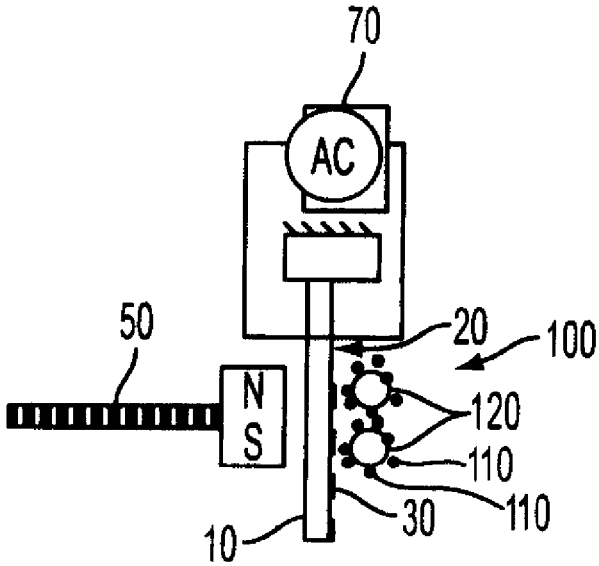

As shown in FIG. 5, a two-component developer sample 100 may be placed, smoothed, and/or positioned on the vibrating element 20 of the sensor 10. The sample 100 may include toner particles 110 and carrier granules 120. After the developer sample 100 is applied, a change between the resonance frequency of the sensor 10, prior to placement of the developer sample 100 and after placement of the developer sample 100, is measured, and the developer mass may be calculated in accordance with the sensor frequency to mass sensitivity.

As shown in FIG. 6, the plurality of electrical elements 30 (e.g. electrodes) are biased by a direct current. This, combined with an increase in the drive amplitude by the vibration controller 70, and/or a decrease in the magnetic force by the magnetic device 50, will vibrationally bounce the carrier granules. Thus, the toner particles 120 may be stripped or "developed" from the carrier granules 120 to the electrodes 30. The carrier granules, once cleaned, may fall off the sensor 10. For example, a DC bias of approximately 400 volts may be used to develop toner on the electrodes. However, a DC bias in the range of 100-1000 volts may be used depending on electrode spacing and overcoat resistivity.

As shown in FIG. 7, after the carrier granules 120 fall from the sensor 10, a third measurement of the resonance frequency of the sensor may be made to determine the mass of the toner particles. The mass of the carrier granules may then be calculated by subtracting the mass of the toner particles from the mass of the developer sample.

Figure 8:
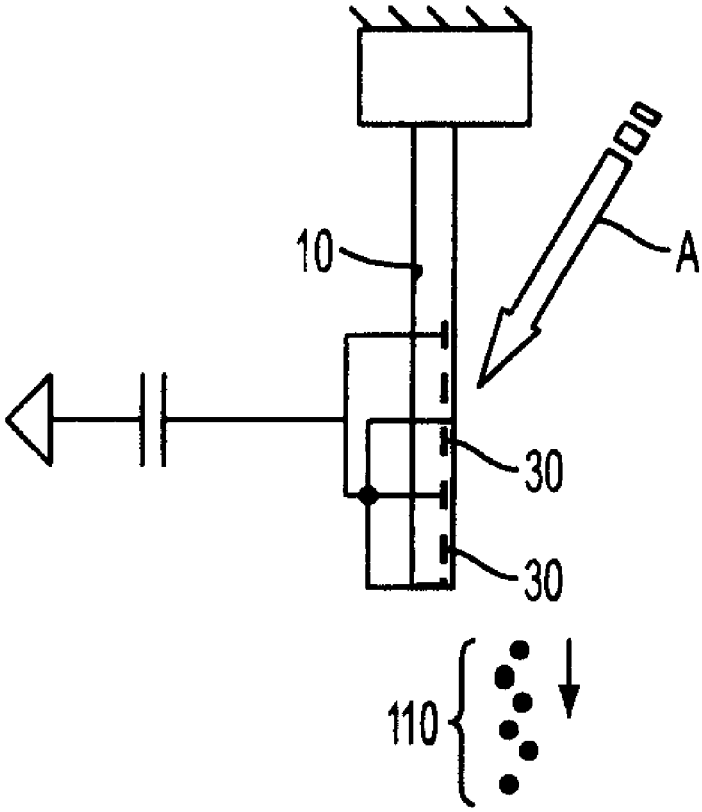

As shown in FIG. 8, the sensor 10 may be cleaned via changing the DC bias of the electrodes (e.g., the plurality of electrical elements 30) on the sensor 10. After changing the bias, an air jet (as illustrated by the arrow A) may be used to remove the toner particles 110 from the sensor 10. After the sensor 10 is cleaned of the components of the developer 100, the charge and resonance frequency of the sensor 10 are measured to determine the mass and charge of the clean sensor. Once again, frequency shift determines mass, allowing toner mass to be calculated. Additionally the sensor change in charge and toner mass can be used to calculate the charge to mass ratio of the toner particles.

Tests using a non-optimized prototype system demonstrated a frequency to mass sensitivity of 7.12 Hz/mg, (data shown in FIG. 9). A resonant frequency measurement precision 0.05 Hz was also obtained. Assuming a sample size of 0.5 mg, this results in a frequency shift of 3.56 Hz. With a precision of 0.05 Hz one can expect better than 2% error based on frequency shift precision. It should be understood that more accurate measurements are capable and contemplated by this disclosure by varying testing parameters and/or using optimized systems with improved sensitivities.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art, and are also intended to be encompassed by the following claims.

What is claimed is:

1. A method of determining a charge to mass ratio, and a concentration, of a mixture including a first component and a second component, the method comprising:

measuring a base resonance frequency of a sensor in an unloaded state;

loading the mixture on a vibrating element of the sensor;

measuring a first resonance frequency of the loaded sensor;

removing the second component from the vibrating element of the loaded sensor, leaving the first component;

measuring a second resonance frequency, and a first charge, of the sensor after removal of the second component;

calculating a mass of the second component based on a difference between the resonance frequency of the sensor loaded with the first and second components and without the second component;

removing the first component from the vibrating element of the sensor;

calculating a mass of the first component based on a difference between the resonance frequency of the sensor loaded with the first component and without the second component, and the unloaded sensor;

calculating a charge of the first component based on a difference between the charge of the sensor loaded with the first component and the unloaded sensor; and calculating the charge to mass ratio, and the concentration, of the first component based on the calculated mass of the first component, the calculated mass of the second component, and the calculated charge of the first component.

2. The method of claim 1, the first component having substantially different dielectric properties or mass than the second component.

3. The method of claim 1, further comprising:

calculating a mass of the mixture based on a difference between the base resonance frequency and the first resonance frequency.

4. The method of claim 1, further comprising:

attracting the first component to the vibrating element of the loaded sensor.

5. The method of claim 4, wherein attracting the first component includes separating the first component from the second component.

6. The method of claim 5, wherein the first component is attracted to the vibrating element of the sensor by increasing a drive amplitude applied to the sensor and reducing a magnetic field in proximity to the sensor.

7. The method of claim 4, wherein the first component is attracted to the vibrating element of the sensor by an applied electrostatic force.

8. The method of claim 1, wherein the mixture is a two-component developer used in an electrostatic image forming device.

9. The method of claim 1, wherein the sensor is a piezoelectric element.

10. The method of claim 1, wherein removing the first component from the vibrating element of the sensor is achieved by altering an applied magnetic force to the sensor.

11. The method of claim 1, wherein loading the mixture on the vibrating element of the sensor includes smoothing and positioning the mixture by increasing a drive amplitude applied to the vibrating element.

12. The method of claim 1, further comprising at least one of storing, utilizing or outputting at least one of the detected, or calculated, mass, charge, concentration and charge to mass ratio.

13. The method of claim 12 wherein the at least one of the detected, or calculated, mass, charge, concentration and charge to mass ratio is utilized by a Xerographic image forming device.

14. A device for determining a charge to mass ratio, and a concentration, of a mixture including a first component and a second component, the device comprising:

a sensor comprising a vibrating element capable of receiving the mixture;

control circuitry, that detects a resonance frequency and charge of the sensor;

a first removal device that removes the second component from the mixture on the vibrating element, leaving the first component;

a calculator that calculates:

a mass of the mixture and a mass of the first component, based on a resonance frequency of the vibrating element, a concentration of the first component based on the calculated mass of the mixture and first component, and a charge to mass ratio based on the calculated mass and the charge detected by the control circuitry; and at least one of a storage device or an output device, for storing or outputting at least one of the detected, or calculated, mass, charge, concentration and charge to mass ratio.

15. The device of claim 14, the mass of the first component being determined after removal of the second component from the mixture on the vibrating element.

16. The device of claim 14, further comprising:

a second removal device for removing the first and second components from the vibrating element.

17. The system of claim 14, further comprising:

a magnetic device that creates a magnetic field in proximity to the sensor; and a biasing device that provides a bias to the sensor, wherein the biasing device and the magnetic device are configured to separate the mixture on the vibrating element of the sensor, the first component having substantially different dielectric properties or mass than the second component.

18. The system of claim 14, further comprising:

a magnetic device that creates a magnetic field in proximity to the sensor; and a biasing device that provides a bias to the sensor, wherein the biasing device and the magnetic device are configured to attract a first component of the sample to a surface of the vibrating element by increasing a drive amplitude applied to the sensor and reducing a magnetic field in proximity to the sensor.

19. A Xerographic image forming device comprising the system of claim 14, wherein, the at least one of the detected, or calculated, mass, charge, concentration and charge to mass ratio is stored, utilized or output by the Xerographic image forming device

20. A system for determining a charge to mass ratio, and a concentration, of a mixture including a first component and a second component, the system comprising:

means for measuring a base resonance frequency of a vibrating element of the sensor in an unloaded state;

means for loading the mixture on a vibrating element of the sensor;

means for measuring a first resonance frequency of the loaded sensor;

means for removing the second component from the vibrating element of the loaded sensor, leaving the first component;

means for measuring a second resonance frequency, and a first charge, of the sensor after removal of the second component;

means for calculating a mass of the second component based on a difference between the resonance frequency of the sensor loaded with the first and second components and without the second component;

means for removing the first component from the vibrating element of the sensor;

means for calculating a mass of the first component based on a difference between the resonance frequency of the sensor loaded with the first component and without the second component, and the unloaded sensor;

means for calculating a charge of the first component based on a difference between the charge of the sensor loaded with the first component and the unloaded sensor; and means for calculating the charge to mass ratio, and the concentration, of the first component based on the calculated mass of the first component, the calculated mass of the second component, and the calculated charge of the first component.

* * * * *